United States Patent [19]

Waters, Sr.

[11] Patent Number: 4,794,857

[45] Date of Patent: Jan. 3, 1989

[54] VARIABLE MARKING APPARATUS

[75] Inventor: David E. Waters, Sr., Beech Island, S.C.

[73] Assignee: C. W. Hock, Jr., Augusta, Ga. ; a part interest

[21] Appl. No.: 132,891

[22] Filed: Dec. 14, 1987

[51] Int. Cl.[4] ..... B41F 17/00

[52] U.S. Cl. ..... 101/328; 33/36

[58] Field of Search ..... 101/328, 329, 330, 331, 101/375, 376, 377, 74, 75, 103, 109, 368, 379; 33/36, 35, 37

[56] References Cited

U.S. PATENT DOCUMENTS

| | | | |
|---|---|---|---|
| 3,537,394 | 11/1970 | Swapp | 101/328 |
| 3,783,785 | 1/1974 | Frank et al. | 101/328 |
| 3,896,725 | 7/1975 | Grover | 101/330 |
| 4,372,049 | 2/1983 | Hogue | 101/328 X |

*Primary Examiner*—Clifford D. Crowder

*Attorney, Agent, or Firm*—James B. Middleton

[57] ABSTRACT

A marking device has a wheel to be rolled along a work piece to be marked into increments, and felt-tip markers distributed along the circumference of the wheel. The rim of the wheel carries one group of holders spaced at 90° apart, and another group of holders spaced at 120° apart. Each holder can receive a marker or not, so the spacings to be marked are variable.

5 Claims, 1 Drawing Sheet

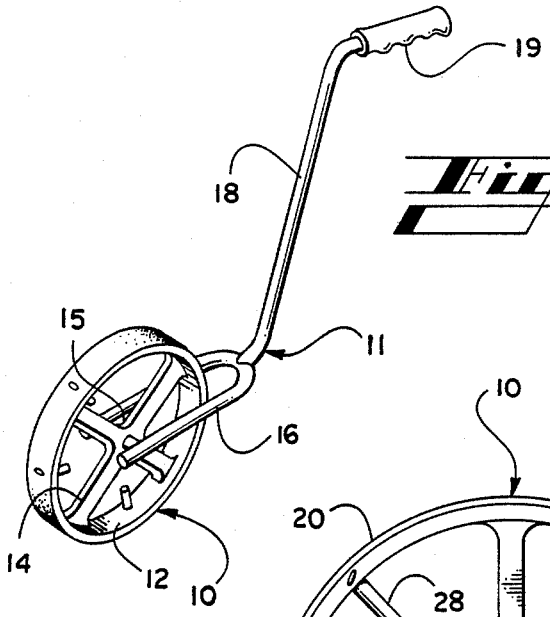
Fig_1
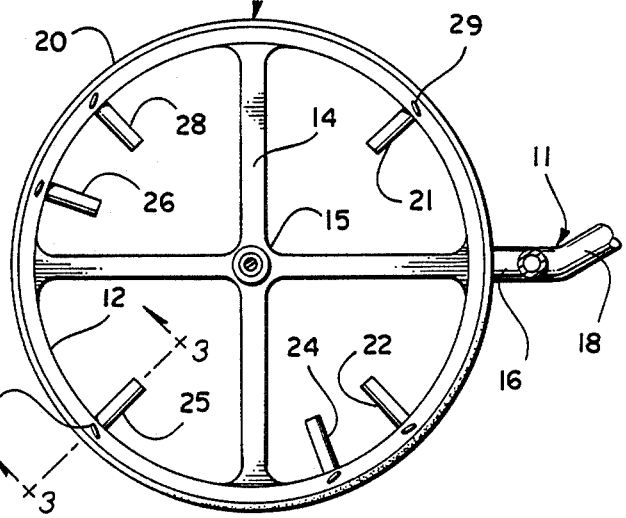
Fig_2
Fig_3
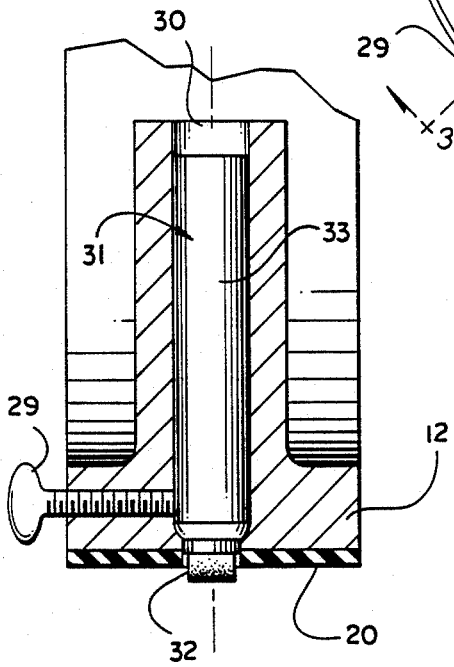
Fig_4
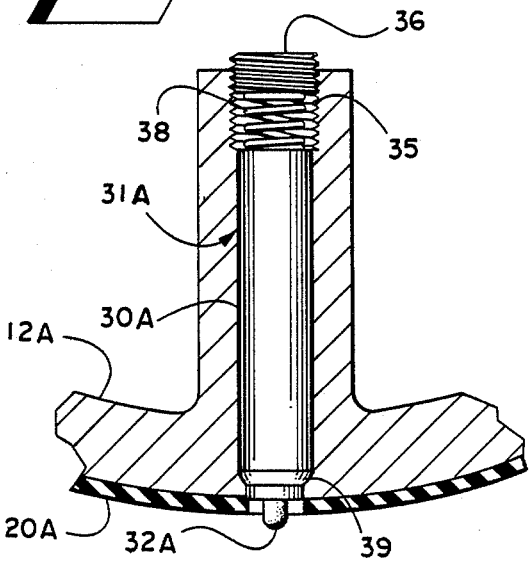

VARIABLE MARKING APPARATUS

INFORMATION DISCLOSURE STATEMENT

There are numerous industries in which a relatively long distance must be divided into a plurality of increments. An obvious example is the construction industry wherein a board must be marked for placement of studs. Those skilled in the art will realize that studs or other support members are placed at different distances, depending on the particular construction and other variables such as the width of standard panels and the like that are to be put on the walls.

With the frequent need to divide distances into increments, there have been several prior art marking devices. The prior art devices include generally a rotatable member having some marking means on the periphery of the rotatable member. One form of prior apparatus is shown in the patent to Pearson U.S. Pat. No. 3,046,884 which utilizes marking devices on the periphery of a drum element, the marking devices being inked by an inking roll. The Pearson device is adapted to be pushed along a board or the like somewhat in the manner of a portable circular saw. Another form of prior device is shown in the patent to Thornton, U.S. Pat. No. 3,988,835. The Thornton device includes a handle that will allow the user to stand erect and push the device along a surface. Marking devices extending from the surface of the wheel provide marks on the work surface as the wheel rolls along the work surface.

The prior art includes additional rotatable marking means, but all of the prior art includes rotary devices that are relatively invariable in their construction. Thus, when the distance between marks is to be varied, one must substitute the entire apparatus, or exchange marking wheel on the apparatus.

SUMMARY OF THE INVENTION

This invention relates generally to marking apparatus, and is more particularly concerned with a rotatable marking apparatus having a plurality of selectively engagable marking means.

The present invention provides a marking apparatus that is rollable along a surface to be marked. The apparatus includes a plurality of individual marking means, and each marking means is selectively usable so that the single marking apparatus can selectively mark a plurality of different increments along a work surface. Further, the apparatus includes two separate groups of marking means that can be used separately or together.

The marking apparatus of the present invention preferably includes handle means to allow a user to stand and walk comfortably while marking a surface.

BRIEF DESCRIPTION OF THE DRAWINGS

These and other features and advantages of the present invention will become apparent from consideration of the following specification when taken in conjunction with the accompanying drawings in which:

FIG. 1 is a perspective view showing a marking apparatus made in accordance with the present invention;

FIG. 2 is an enlarged elevational view of the wheel portion of the apparatus shown in FIG. 1, the handle of the apparatus being partially broken away to show the construction;

FIG. 3 is an enlarged cross-sectional view taken substantially along the line 3—3 in FIG. 2; and, FIG. 4 is an enlarged fragmentary view showing a modified form of marker holder.

DETAILED DESCRIPTION OF THE EMBODIMENTS

Referring now more particularly to the drawings, and to those embodiments of the invention here presented by way of illustration, FIG. 1 shows a marking apparatus including a wheel generally designated at 10 and a handle generally designated at 11. The wheel 10 includes a rim 12 having spokes 14 for connecting the rim 12 to the hub 15. The hub 15 carries an axle that connects to a fork 16, the fork 16 being a portion of the handle 11.

The fork 16 is here shown as being disposed generally horizontally, while the tongue 18 extends upwardly to the desired height, and turns into a grip portion 19 that may include a handle bar grip or the like.

It will therefore be understood that a user of the marking device shown in FIG. 1 of the drawings will stand and grasp the grip portion 19 in one hand. In this position, the user can simply walk along the workpiece to be divided, and the wheel 10 will roll along the surface and provide appropriate markings at predetermined increments.

Looking now at FIG. 2 of the drawings, the wheel 10 is shown in more detail, and it will be seen that the rim 12 mounts a band 20 of rubber or the like to provide a surface that will not slip on the work piece. It will be obvious that surfaces other than rubber may be used, the band 20 preferably being selected not to slip on the work piece being marked.

In FIG. 2 it will be seen that there is a plurality of marker holders 21, 22, 24, 25, 26, and 28. As will be discussed below, each of these marker holders is adapted to receive a marking means, preferably in the form of a felt tip marker or the like; and, each of the marker holders 21–28 includes means for retaining a marker within the holder. In FIG. 2 there is a thumbscrew 29 adjacent to each of the marker holders, and this construction is better shown in FIG. 3 of the drawings.

Looking further at FIG. 2, it will be realized that the marking holder 21 can be considered as the principal holder. While all the marker holders are constructed alike, holder 21 is the reference point for two separate groups of holders. Thus, holder 21 can be considered to be located at 0° of arc.

The first group of marker holders, then, includes holders 21, 22, 25 and 28, which are spaced 90° apart around the circumference of the rim 12. As a result, use of this first group of marker holders allows the circumference of the wheel 10 to be divided equally into 1, 2 or 4 increments.

The second group of marker holders includes holders 21, 24 and 26, which are spaced 120° apart around the circumference of the rim 12. As a result, use of this second group of marker holders allows the circumference of the wheel 10 to be divided equally into three increments.

While it is obvious that either on or the other group of marker holders can be used at one time, it should also be recognized that both groups may be used simultaneously by separating the groups with different shapes, colors or the like.

Turning now to FIG. 3, the marker holder 25 is shown as formed integrally with the rim 12. While it may sometimes be convenient to form the marking apparatus in this manner, it will also be understood by those skilled in the art that the rim could be formed separately and the marker holders subsequently attached by any conventional means.

Extending generally centrally of the marker holder 25, there is a bore 30 appropriately sized to receive the marker 31. As is well known to those skilled in the art, the marker 31 includes a barrel 33 for containing a supply of ink or the like, and a tip 32 usually made of a fibrous material, or a sponge-like plastic material for feeding ink from the barrel 33 to the tip 32. In FIG. 3 it will also be seen that the thumb-screw 29 is received within a threaded hole that extends through the rim 12 to the bore 30 so that the thumb screw 29 acts as a set screw to hold the marker 31 in a preset location.

From the foregoing description, it will be understood that one will place a marker such as the marker 31 in one or more of the marker holders 21–28. Each marker 31 will have its tip 32 placed to extend just beyond the periphery of the band 20 so the tip 32 will engage the work surface as the wheel 10 rolls over the work surface. Each time the tip 32 engages the work surface, a mark will be made on the work surface.

Looking briefly at FIG. 4 of the drawings, a slight modification of the marker holder 25 is shown, the marker holder in FIG. 4 being designated as 25A. There is a marker 31A received within a bore 30A, the marker 31A having a tip 32A extending beyond the band 20A.

At the innermost end of the marker holder 25, it will be seen that the interior of bore 30A is threaded as at 35, the threads 35 receiving a threaded plug 36. A spring 38 extends between the plug 36 and the marker 31A to urge the marker 31A outwardly of the wheel 10; and, the bore 30A is narrowed at 39 to provide shoulders for limiting the outward movement of the marker 31A.

It will therefore be understood that the embodiment shown in FIG. 4 of the drawings is the same as that shown in FIG. 3 except that the marker 31A is spring urged outwardly. As the tip 32A engages the work piece, the force of the spring 38 will hold the tip 32A against the work piece sufficiently to make a mark, but the spring 38 can be compressed to prevent bouncing or other erratic rolling of the wheel 10.

From the foregoing description, the use of the apparatus should now be understandable. The wheel 10 will of course be made with a circumference commensurate with the desired increments to be marked, and this circumference might vary with the industry and the particular work pieces to be marked. Given the specific circumference, the marker holders such as the marker holder 25, will be placed around the circumference of the wheel to yield the desired incremental lengths.

While the marking apparatus can be used in virtually any industry, the building industry will be used by way of example, and in this industry a wheel 10 having a circumference of 48 inches will be quite useful. The 48 inch circumference can be utilized with one marker, for example in the holder 21, and each revolution of the wheel 10 will provide one mark so that the work surface will be divided into increments of 48 inches. This is of course the conventional width of sheets of plywood, wallboard and the like.

In some buildings, the studs for the walls are placed 24 inches apart. To achieve this marking, one can place a marker in the holders 21 and 25 thereby dividing the total circumference of the wheel into two, so that the marks are 24 inches apart. Further divisions can be made by adding markers to the holders 22 and 28, and marks will be made 12 inches apart since the circumference of the wheel 10 will be divided into four equal pieces.

It will also be understood that studs for walls are sometimes placed on 16 inch centers. Utilizing the marking appratus of the present invention, it will be seen that a marker can be placed in the marker holder 21 as before, and markers can also be placed in the marker holders 24 and 26. It will be seen that the marker holders 21, 24 and 26 are 120° apart on the wheel 10 so the circumference of the wheel 10 is divided into three equal increments. Each time the wheel 10 is rolled along the work surface, it will therefore provide three equally spaced marks 16 inches apart.

While the above discussion contemplates the use of a limited number of markers in the marking apparatus to mark the desired increments, it will also be understood that more than one kind of marking can be done on the same pass by utilizing more of the marker holders 21–28 and utilizing different shapes or colors of markers. Thus, one might place one marker in the marker holder 21, for example black, and a different marker in the marker holder 25, for example red. With this arrangement, marks would be placed 24 inches apart, but red marks would be placed 48 inches apart. Thus, a stud could be placed at each mark, but firring strips for panelling or the like could be placed on each red mark. Numerous other combinations will suggest themselves to those skilled in the art.

It will therefore be seen that the present invention provides an extremely simple marking apparatus that is highly versatile. The apparatus can be made of metal, or of stable plastic materials or the like. The marker holders are such that the individual markers such as the markers 31 and 31A are expendable and can be readily replaced to change the shape of the marker tip, the color of the mark, or the like. With the plurality of marker holders arranged as indicated, it will be seen that a great variety of markings can be made with the same marking appratus simply by adding or subtracting the particular markers in the marker holders.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. A marking apparatus for marking a work piece into increments, said marking apparatus including a wheel for rolling along said work piece, and a handle for controlling said wheel, said wheel comprising a rim having a circumference, a hub centrally of said rim, an axle at the center of said hub, said axle rotatably connecting said handle to said wheel, and a plurality of marking means distributed along said circumference of said rim, said plurality of marking means being so spaced as to divide said circumference into equal increments, each marking means of said plurality of marking means being selectively usable so that said equal increments are selectively variable, each marking means of said plurality of marking means including a marker holder fixed to said rim and extending generally radially thereof, said marker holder defining a bore for selectively receiving a marker, said marker including a marking tip for marking said work piece, said rim defining a hole aligned with said bore, means for urging said marking tip through said hole in said rim and against said work piece, said means for urging said marking tip through said hole including a spring within said bore, and further including a shoulder for limiting radial motion of said marker, said plurality of marking means comprising a first marking means located at zero degrees on said circumference, a first group of said marking means uniformly distributed around said circumference at a first spacing from said first marking means, and a second group of said marking means uniformly distributed around said circumference at a second spacing from said first marking means.

2. A marking apparatus as claimed in claim 1, and further including a band carried by said rim, said band including a non-slip surface relative to said work piece.

3. A marking apparatus as claimed in claim 1, said first group of said marking means comprising marking means located at ninety, one hundred eighty and two hundred seventy degrees, and said second group of said marking means located at one hundred twenty and two hundred forty degrees.

4. A marking apparatus for marking a work piece into increments, said marking apparatus including a wheel for rolling along said work piece, and a handle for controlling said wheel, said wheel comprising a rim having a circumference, a hub centrally of said rim, an axle at the center of said hub, said axle rotatably connecting said handle to said wheel, and a plurality of marking means distributed along said circumference of said rim, said plurality of marking means being so spaced as to divide said circumference into equal increments, each marking means of said plurality of marking means being selectively usable so that said equal increments are selectively variable, each marking means of said plurality of marking means including a marker holder fixed to said rim and extending generally radially thereof, said marker holder defining a bore for selectively receiving a marker, said marker including a marking tip for marking said work piece, said rim defining a hole aligned with said bore, means for urging said marking tip through said hole in said rim and against said work piece, said means for urging said marking tip through said hole including a set screw for selectively fixing said marker with respect to said bore with said marking tip extending through said hole, said plurality of marking means comprising a first marking means located at zero degrees on said circumference, a first group of said marking means uniformly distributed around said circumference at a first spacing from said first marking means, and a second group of said marking means uniformly distributed around said circumference at a second spacing from said first marking means.

5. A marking apparatus as claimed in claim 4, said first group of said marking means comprising marking means located at ninety, one hundred eighty and two hundred seventy degrees, said second group of said marking means located at one hundred twenty and two hundred forty degrees.

* * * * *